US008419211B2

(12) United States Patent
Chi et al.

(10) Patent No.: US 8,419,211 B2
(45) Date of Patent: Apr. 16, 2013

(54) LAMP TUBE

(75) Inventors: Der-Ho Chi, New Taipei (TW); Yang-Jui Chao, New Taipei (TW); Zhi-Qiang Xie, Shenzhen (CN); Xiao-Yin Zhou, Shenzhen (CN); Mi Tang, Shenzhen (CN); Xiao-Jun Hao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 142 days.

(21) Appl. No.: 13/187,472

(22) Filed: Jul. 20, 2011

(65) Prior Publication Data

US 2012/0262913 A1 Oct. 18, 2012

(30) Foreign Application Priority Data

Apr. 15, 2011 (CN) ..... 2011 1 0094632

(51) Int. Cl.
*F21S 4/00* (2006.01)
*F21V 23/02* (2006.01)

(52) U.S. Cl.
USPC ... 362/221; 362/222; 362/217.1; 362/217.12; 362/249.02; 362/311.02

(58) Field of Classification Search ..... 362/221, 362/222, 217.1–217.13, 249.02, 249.06, 362/311.02, 351, 353
See application file for complete search history.

(56) References Cited

U.S. PATENT DOCUMENTS 8,177,388 B2 * 5/2012 Yen ..... 362/221
8,304,993 B2 * 11/2012 Tzou et al. ..... 362/219
8,324,817 B2 * 12/2012 Ivey et al. ..... 315/151

FOREIGN PATENT DOCUMENTS

CN 2884611 Y 3/2007
CN 100540994 C 9/2009

* cited by examiner

*Primary Examiner* — Stephen F Husar
(74) *Attorney, Agent, or Firm* — Altis Law Group, Inc.

(57) ABSTRACT

A lamp tube includes a lamp shade, connectors fixed to opposite ends of the lamp shade, and a circuit board received in the lamp shade and electrically connected with the connectors. At least two resilient members protrude from opposite sides of the circuit board. Each resilient member is resiliently deformed and urged into contact with an inner surface of the lamp shade. The deformation of the at least two resilient members is for providing a spring push force to the circuit board, thus causing the circuit board to tightly engage the inner surface of the lamp shade, thereby retaining the circuit board in position inside the lamp shade.

7 Claims, 4 Drawing Sheets

LAMP TUBE

BACKGROUND

1. Technical Field

The present disclosure relates to lamp tubes, particularly, to an lamp tube capable of simplifying the fixing structure of circuit board of the lamp tube.

2. Description of Related Art

A conventional LED lamp usually includes a lamp shade, a circuit board fixed in the lamp shade and two lamp holders fixed at two end of the lamp shade. The circuit board is fixed in the lamp shade by engagement between guide slots and hooks, which increase the time and cost of manufacture.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
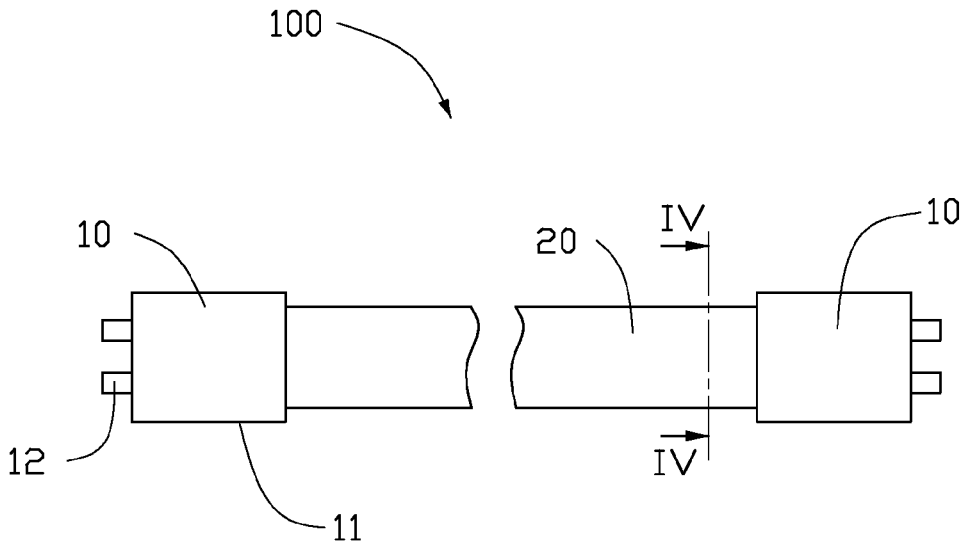
FIG. 1 is a schematic view of a lamp tube in accordance with an exemplary embodiment.

Referring to FIG. 1, in an embodiment, an LED lamp tube 100 includes a connector 10 and a light-emitting module 20. The connectors 10 are fixed to opposite ends of the light-emitting module 20. Each of the connectors 10 includes a connection portion 11 and two pins 12 penetrating the connection joint 11 and fixed to the connection portion 11. The connection portions 11 are respectively fixed to the opposite ends of the light-emitting module 20. The two pins 12 are electrically connected to power adapters (not shown), thereby allowing electrical power to be supplied to the LED lamp tube 100.

Figure 2:
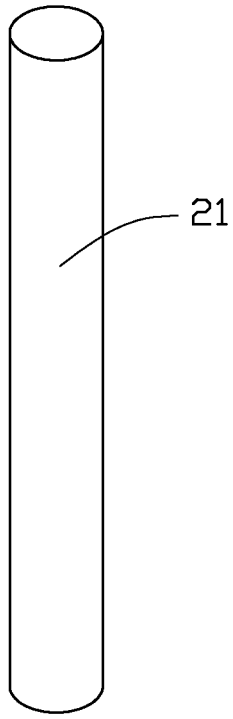
FIG. 2 is a schematic view of a lamp shade of the lamp tube of FIG. 1.
Figure 3:
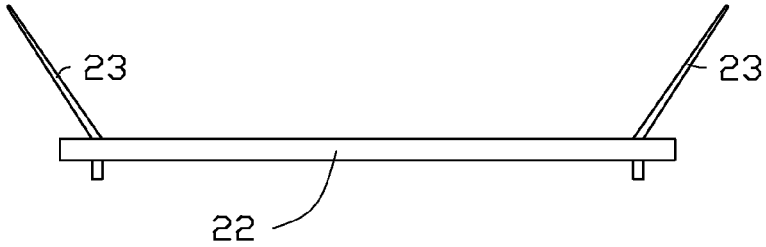
FIG. 3 is a side view of a circuit board of the lamp tube of FIG. 1 with two resilient members.

Referring to FIGS. 2 and 3, the light-emitting module 20 includes a cylindrical light-pervious lamp shade 21 and a circuit board 22 received in the lamp shade 21. At least two resilient members 23 are respectively fixed to opposite sides of the circuit board 22. In the embodiment, each resilient member 23 is outwardly inclined with respect to the circuit board 22. The distance between the free ends of the two resilient members 23 is thus greater than the width of the circuit board 22.

In the embodiment, the lamp shade 21 is a hollow cylinder and is made of fireproofing material with good light-admitting quality. The inner surface of the lamp shade 21 is a smooth surface brought into contact with the resilient members 23 and the circuit board 22. A plurality of LEDs (not shown) are fixed to the circuit board 22. The width of the circuit board 22 is substantially equal to the inner diameter of the lamp shade 21. In the embodiment, the circuit board 22 has a rectangular shape. The number of the resilient members 23 is four, and the four resilient members 23 are substantially arranged on the four corners of the circuit board 22 respectively. The resilient members 23 are elongated resilient metal strips, and can be made of plastic or metal.

In an alternatively embodiment, the number of the resilient members 23 can be varied according to need.

Figure 4:
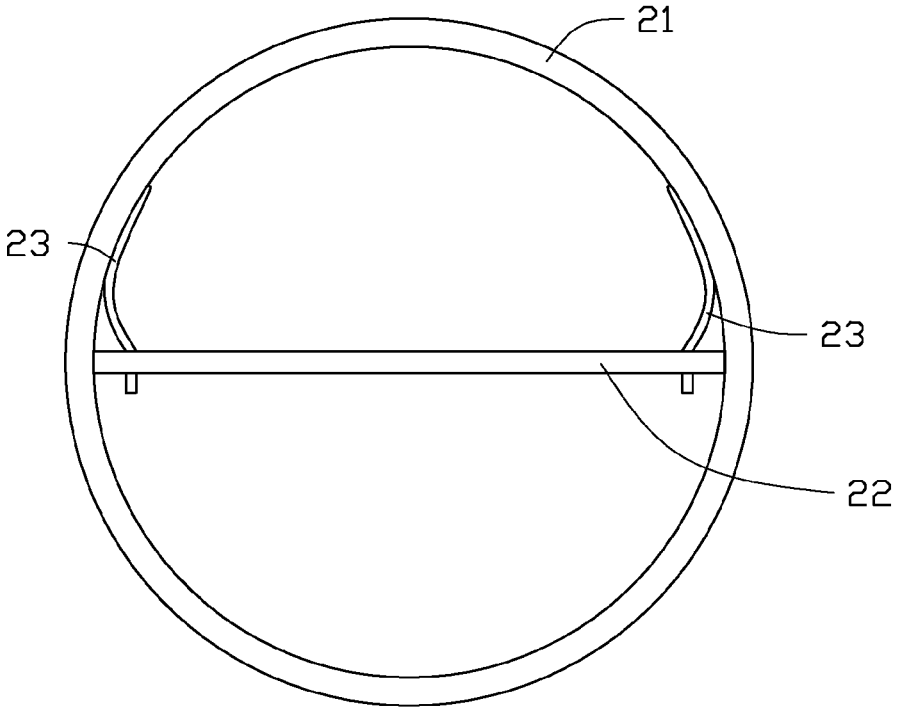
FIG. 4 is a cross-sectional view of the lamp tube of FIG. 1 taken along lines IV-IV.

Referring to FIG. 4, when assembling the LED lamp tube 100, the circuit board 22 with the resilient members 23 is inserted into the lamp shade 21 from the open end of the lamp shade 21. The resilient members 23 are urged to be bent and abut against the inner lateral surface of the lamp shade 21 to fix the circuit board 22 to the lamp shade 21, which urge the sides of the circuit board 22 to tightly engage the internal lateral surface of the lamp shade 21, thereby retaining the circuit board 22 in position inside the lamp shade 21.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A lamp tube comprising:

a cylindrical light-pervious lamp shade;

two connectors fixed to opposite ends of the lamp shade;

a circuit board received in the lamp shade and electrically connected with the connectors; and at least two resilient members protruding from opposite sides of the circuit board, each of the at least two resilient members being resiliently deformed and urged into contact with an inner surface of the lamp shade, the deformation of the at least two resilient members configured for providing a spring push force to the circuit board, thus causing the circuit board to tightly engage the inner surface of the lamp shade, thereby retaining the circuit board in position inside the lamp shade.

2. The lamp tube as described in claim 1, wherein the width of the circuit board is substantially equal to the inner diameter of the lamp shade.

3. The lamp tube as described in claim 1, wherein each of the resilient members is outwardly inclined relative to the circuit board.

4. The lamp tube as described in claim 1, wherein the at least two resilient members comprises four resilient members, the circuit board has a rectangular shape, the four resilient members are arranged at the four corners of the circuit board respectively.

5. The lamp tube as described in claim 1, wherein at least a light emitting diode is mounted on the circuit board.

6. The lamp tube as described in claim 1, wherein the resilient members are elongated resilient metal strips.

7. The lamp tube as described in claim 1, wherein the inner surface of the lamp shade is a smooth surface brought into contact with the resilient members and the circuit board.

* * * * *